US008459161B2

(12) United States Patent
Moellering

(10) Patent No.: US 8,459,161 B2
(45) Date of Patent: Jun. 11, 2013

(54) BALL LOCK PUNCH RETAINER

(75) Inventor: David J. Moellering, Orchard Lake, MI (US)

(73) Assignee: Moeller Precision Tool, LLC, Wixon, MI (US)

( * ) Notice: Subject to any disclaimer, the term of this patent is extended or adjusted under 35 U.S.C. 154(b) by 1095 days.

(21) Appl. No.: 11/372,428

(22) Filed: Mar. 9, 2006

(65) Prior Publication Data

US 2007/0209494 A1 Sep. 13, 2007

(51) Int. Cl.
*B26D 7/26* (2006.01)

(52) U.S. Cl.
USPC ..... 83/698.31; 83/698.91

(58) Field of Classification Search
USPC ..... 83/698.31, 698.91
See application file for complete search history.

(56) References Cited

U.S. PATENT DOCUMENTS

| | | | | | |
|---|---|---|---|---|---|
| 1,621,811 | A | | 3/1927 | Richard et al. | |
| 1,822,468 | A | * | 9/1931 | Wales | 83/140 |
| 2,364,733 | A | * | 12/1944 | McCollum | 279/76 |
| 2,382,267 | A | * | 8/1945 | Stellin | 279/76 |
| 2,580,930 | A | * | 1/1952 | Kost | 279/30 |
| 3,106,122 | A | | 10/1963 | Newcomb | |
| 3,137,193 | A | | 6/1964 | Whistler, Sr. et al. | |
| 3,467,402 | A | * | 9/1969 | Parker | 279/30 |
| 3,535,967 | A | | 10/1970 | Whistler, Sr. et al. | |
| 3,563,124 | A | | 2/1971 | Gargrave | |
| 3,589,226 | A | | 6/1971 | Shadowens, Jr. | |
| 4,103,574 | A | | 8/1978 | Greer | |
| 4,558,620 | A | | 12/1985 | Wallis | |
| 5,038,599 | A | | 8/1991 | Wellman | |
| 5,181,438 | A | | 1/1993 | Wellman | |
| 5,357,835 | A | * | 10/1994 | Moellering | 83/698.31 |
| 5,860,315 | A | * | 1/1999 | Sawdon | 72/481.8 |
| 6,463,839 | B2 | * | 10/2002 | Ohtsuka et al. | 83/698.91 |
| 7,051,635 | B2 | * | 5/2006 | Morehead | 83/698.31 |

FOREIGN PATENT DOCUMENTS

| | | | |
|---|---|---|---|
| JP | 58125626 | A | 8/1983 |
| JP | 1127620 | A | 8/1989 |
| WO | WO-9403310 | A1 | 2/1994 |
| WO | WO-0103860 | A2 | 1/2001 |

OTHER PUBLICATIONS

North American Punch Manufacturers Association (NAPMA) Website. North American Standard "Retainers: Ball-Lock, Light and Heavy Duty, Metric." NAPMA—0128-02. Copyright 2003. [online][retrieved May 27, 2008]. 17 pages. Retrieved from the Internet:<URL:http://www.napma.org/.

North American Automotive Metric Standards (NAAMS) Website. The NAAMS Global Standard Components. Copyright 1997. [online][retrieved May 27, 2008]. 6 pages. Retrieved from the Internet:<URL:http://www.naamsstandards.org/.

* cited by examiner

*Primary Examiner* — Robert Scruggs
(74) *Attorney, Agent, or Firm* — Gifford, Krass, Sprinkle, Anderson & Citkowski, P.C.

(57) ABSTRACT

A punch retainer can utilize a spring passage to retain a locking ball and a spring. A retaining member can be disposed in the spring passage to hold the spring and ball therein and to impart a desired compressive force on the spring. The retaining member can be axially aligned with the centerline of the spring passage and can axially compress the spring. The retaining member can be adjusted to adjust the compression of the spring. A single dowel passage can be utilized to accurately align the retainer in a desired orientation.

16 Claims, 8 Drawing Sheets

BALL LOCK PUNCH RETAINER

FIELD

The present disclosure relates to retainers for punches that use a ball lock, for example those used in punch presses in the stamping industry.

BACKGROUND AND SUMMARY

The statements in this section merely provide background information related to the present disclosure and may not constitute prior art.

Punch retainers can be used to retain a punch in a desired position. For example, punch retainers can be used in punch presses in the stamping industry to form and pierce various materials. Punch retainers enable the punches to be accurately positioned with respect to the complementary die and to be quickly and easily replaced without loss of the accurate punch position at set-up.

Punch retainers, in general, use socket-head cap screws and are a steel body that is bolted to die sets in which the punch is inserted into. The punch is retained by a spring-loaded ball that wedges into a detent in the punch and holds the punch during its utilization. The punches may use a backing plate across the entire bottom of the retainer or a plug behind the punch as its backing member. The use of either a backing plate across the entire bottom of the retainer or a plug behind the punch as its backing member results in a more complicated punch retainer and increases the number of parts. Moreover, the use of the extra parts can increase the cost of manufacturing and producing the punch retainer.

Typically, three or more dowels are used to position the retainer in a desired orientation so that the punch being held therein forms the aperture in a desired location. The preparation of three openings to receive the three dowels within the die retainer, however, is time consuming and increases the cost of producing the retainer. Typically, two or more fasteners are used to fasten the retainer to a press platen or die set. The preparation of two or more openings to receive the fasteners within the die retainer, however, is time consuming and increases the cost of producing the retainer. Additionally, the use of three or more dowels and two or more fasteners also increases the cost of preparing the press platen or die set in that these components also require complementary openings to receive the dowels and fasteners. Furthermore, the typical punch retainers have an exterior shape that is configured to align with other punch retainers. As such, these exterior shapes typically require machining of the exterior surface to form the punch retainers. This machining operation increases the cost of producing such retainers.

An improved punch retainer eliminating the need for the backing plate or plug behind the punch is disclosed in U.S. Pat. No. 5,357,835, assigned to the Assignee of the present invention and incorporated by reference herein. The improved retainer utilizes a blind flat bottom borehole for the punch receptacle. The bottom of the blind hole protects the press platen or die set from wear and impact damage. The punch hole is counterbored at the bottom to eliminate any fillet with the side wall and permit perfectly flat grinding to the periphery. The dowel pin hole centered on the centerline of the punch is formed directly in the retainer body, thus eliminating a source of inaccuracy arising from the separate backing plug and backing plate utilized in other punch retainers.

With a backing plate no longer being required, however, the oblique opening in the retainer within which the spring and ball lock are disposed is open to the exterior and exposed when the retainer is uninstalled. An undercut and a spring with an enlarged portion can be utilized to hold the spring in place when the retainer is uninstalled. The undercut and spring with an enlarged end is typically sufficient to hold the spring in. However, if forces are applied to the ball when the retainer is uninstalled, the spring can possibly release and may result in the spring and/or ball falling out of the retainer. A snap ring can be used to positively retain the spring within the aperture. The snap ring, however, is an additional expense and can be difficult to install and uninstall. Additionally, the forming of an undercut in the opening is another manufacturing expense. Moreover, the use of a spring with an enlarged end can cost more than a traditional spring having a uniform exterior dimension in similar-sized ends.

In accordance with the present teachings, a punch retainer can include a body with a punch-retaining passage and a spring passage. The spring passage can have an intersecting area with the punch-retaining passage and the spring passage can have a threaded section. A ball can be disposed in the spring passage. A spring can be disposed in the spring passage and can bias the ball toward the intersecting area. A threaded member can be disposed in the spring passage and can engage with the threaded section therein. The threaded member can compress the spring into the ball. The threaded member can retain the spring in the spring passage.

In another aspect of the present teachings, the punch retainer can include a body having a flat surface. A punch-retaining passage and a spring passage can be in the body and can have an intersecting area. A spring can be disposed in the spring passage and can bias a ball in the spring passage toward the intersecting area. There can be a single dowel passage for holding a locating dowel. The dowel passage can be coaxial to and of a smaller diameter than the punch-retaining passage. In yet another aspect, there can be a single fastener passage for receiving a fastener that attaches the retainer to a press platen or die set.

A retainer according to the present teachings is advantageous over traditional retainers in that a regular spring not requiring special features, such as an enlarged end, can be utilized to provide a ball lock for the punch. Avoiding a specialized spring can reduce the cost of the retainer. Moreover, the retainer can avoid the use of an undercut, thereby saving a manufacturing step. Furthermore, the retaining member for the spring can be adjusted to compensate for deterioration in the performance of the spring. The ability to compensate for deterioration in the performance of the spring can advantageously increase the useful life of the spring and result in a longer useful life of the retainer before the spring is replaced. Additionally, the axial alignment of the spring with the retaining member facilitates the manufacture of the oblique channel within which the spring, ball and retaining member are disposed. Moreover, the use of a single dowel and single hold-down fastener to position and hold the retainer in a desired orientation can advantageously simplify and reduce the manufacturing costs for the retainer. Moreover, the retainer according to the present teachings can be cylindrical in shape. The cylindrical shape advantageously facilitates the manufacture of the retainer from bar stock material as the bar stock material is already cylindrical in shape. Additional advantages and features of the present teachings will become apparent from the following description and appended claims, taken in conjunction with the accompanying drawings provided herein. It should be appreciated that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
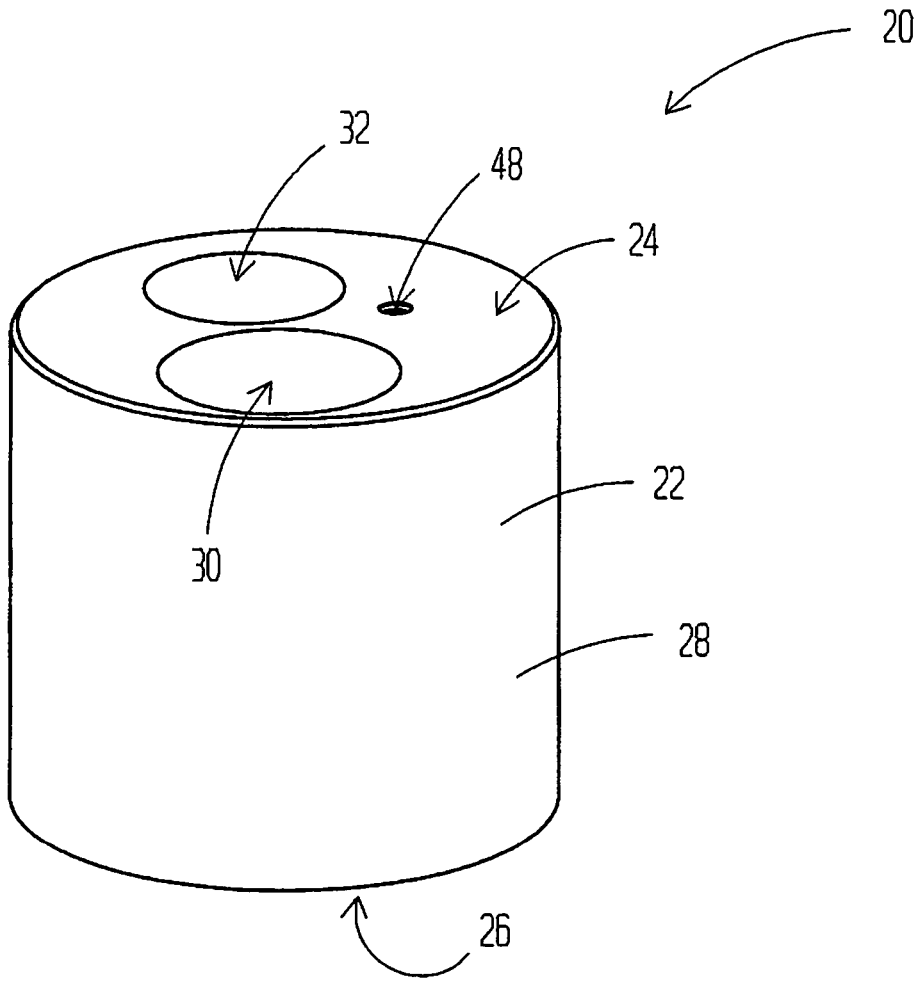
FIGS. 1 and 2 are perspective views showing the top and bottom surfaces of the retainer according to the present teachings.
Figure 2:
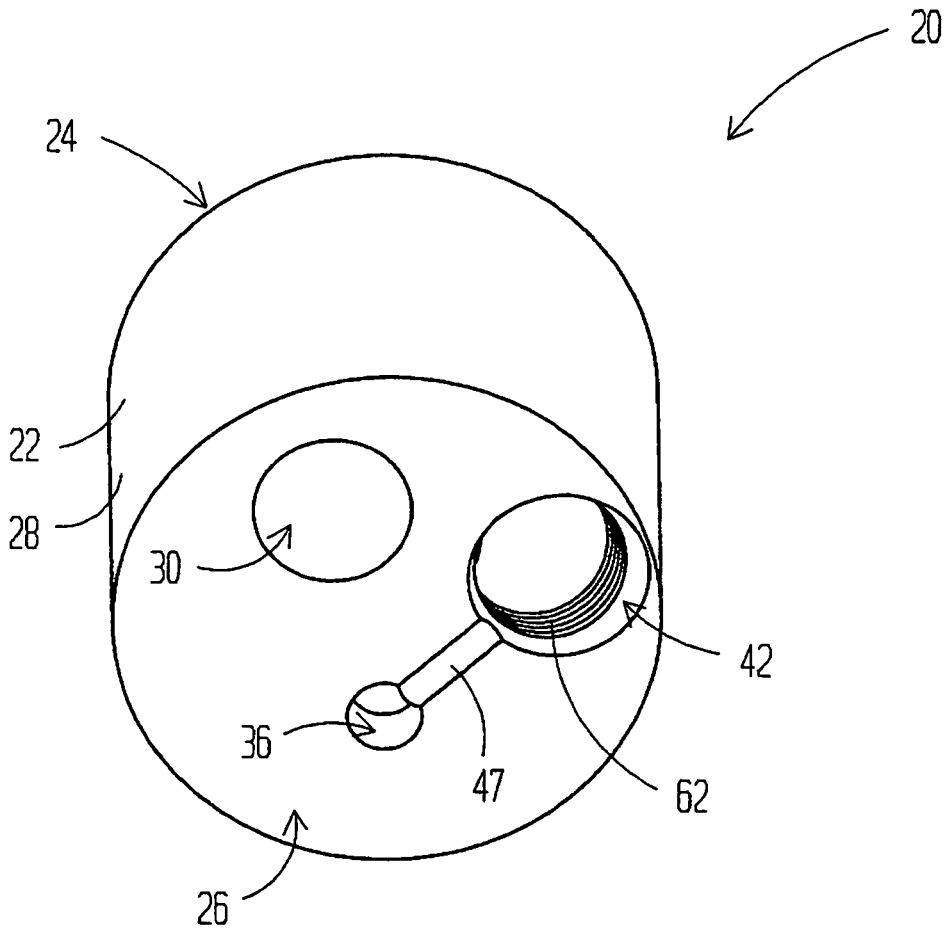
Figure 3:
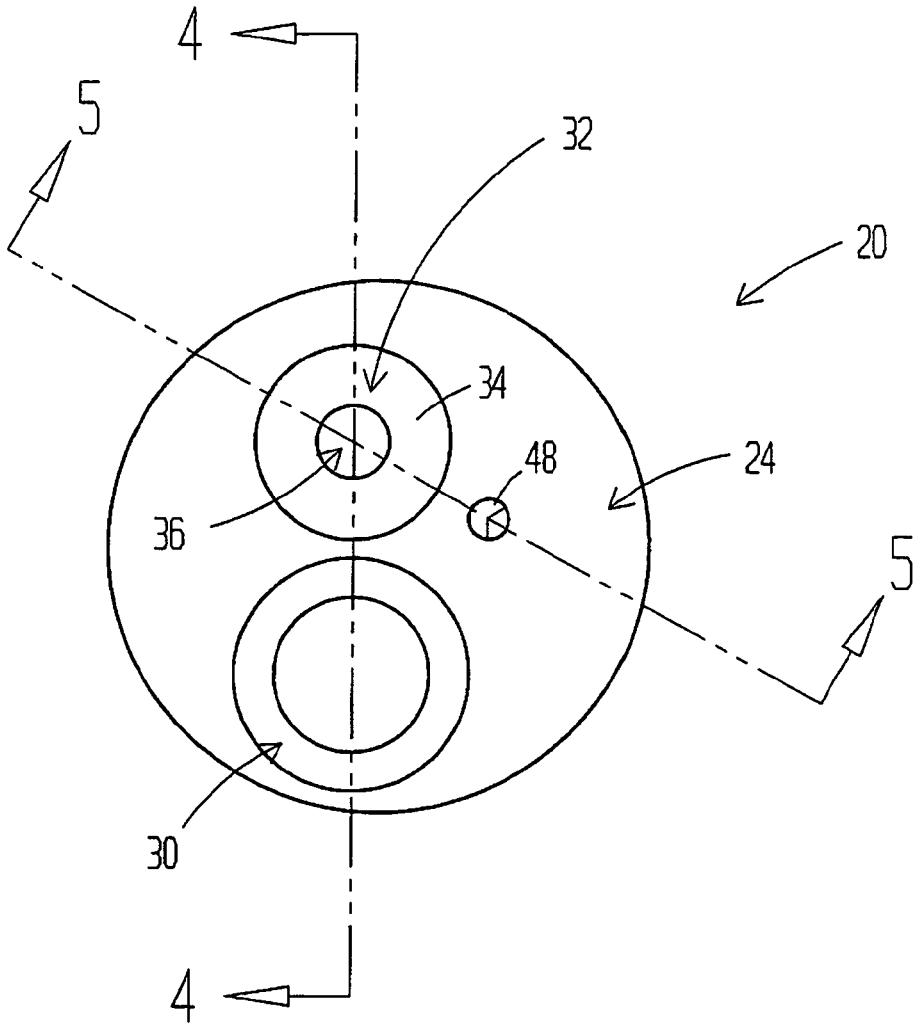
FIG. 3 is a top plan view of the retainer of FIGS. 1 and 2.
Figure 4:
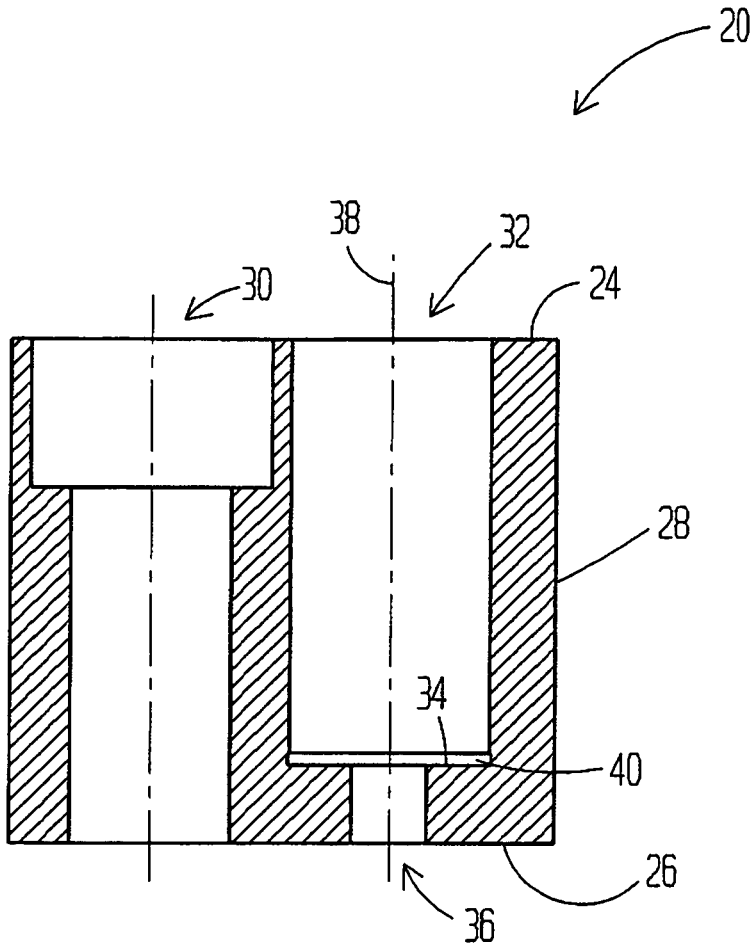
FIG. 4 is a cross-sectional view along line 4-4 of FIG. 3.

The following description is merely exemplary in nature and is not intended to limit the present disclosure, application, or uses.

FIGS. 1-8 illustrate a retainer 20 according to the present teachings. Retainer 20 can include a body 22 of through hardened tool steel. Retainer 20 shown is typical of a large family of different-sized retainers. Body 22 includes a top surface 24, a bottom surface 26 and a side wall 28 extending axially therebetween. Body 22 can be cylindrical. Bottom surface 26 can be flat and can be held against a press platen or die set when in use. Body 22 is pierced by a plurality of holes or passages for various purposes. A first hole or passage 30 can be counterbored and used for bolts or fasteners that hold flat bottom surface 26 of retainer 20 against a press platen or die set. A second hole or passage 32 is a punch hole that terminates at a circular flat bottom 34 within body 22. Flat bottom 34 is pierced by a smaller hole or passage 36 that completes the passage through body 22. Smaller hole 36 can be a dowel pin hole very accurately centered on a centerline 38 of punch hole 32. Dowel pin hole 36 can receive a dowel 39, such as that shown in FIG. 6, to locate retainer 20 on a press platen or die set. To complete punch hole 32, an undercut relief groove 40 can be counterbored into the side wall of punch hole 32 just above flat bottom 34. Groove 40 eliminates any fillet that otherwise might prevent a punch from properly seating on flat bottom 34 and permits flat bottom 34 to be fully ground flat to the periphery of the bottom at the punch hole sidewall.

Figure 5:
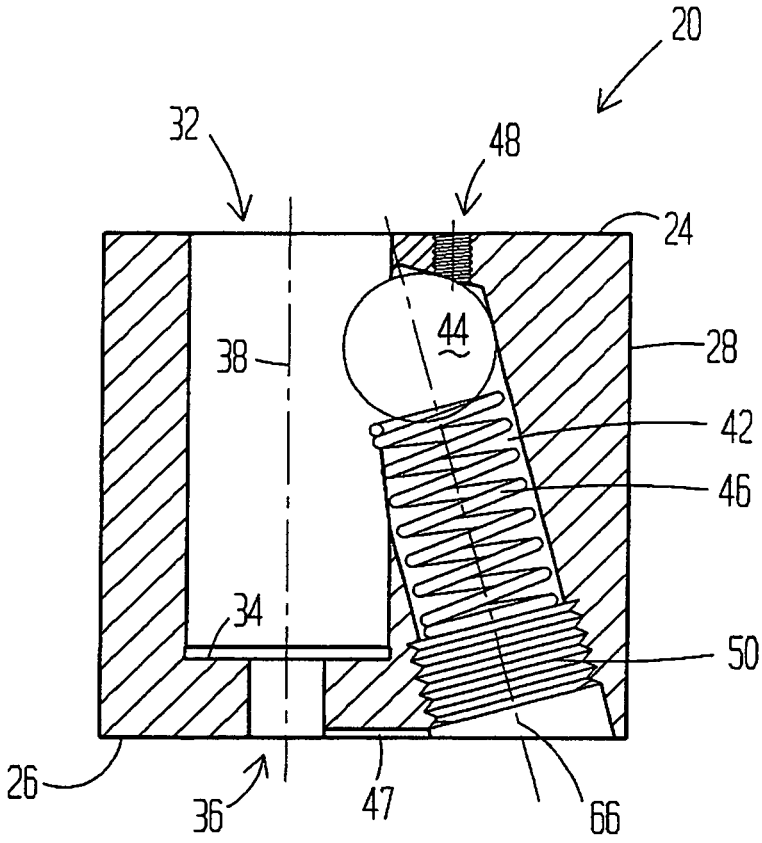
FIG. 5 is a cross-sectional view along line 5-5 of FIG. 3 with the locking ball, spring and retaining member disposed therein.
Figure 6:
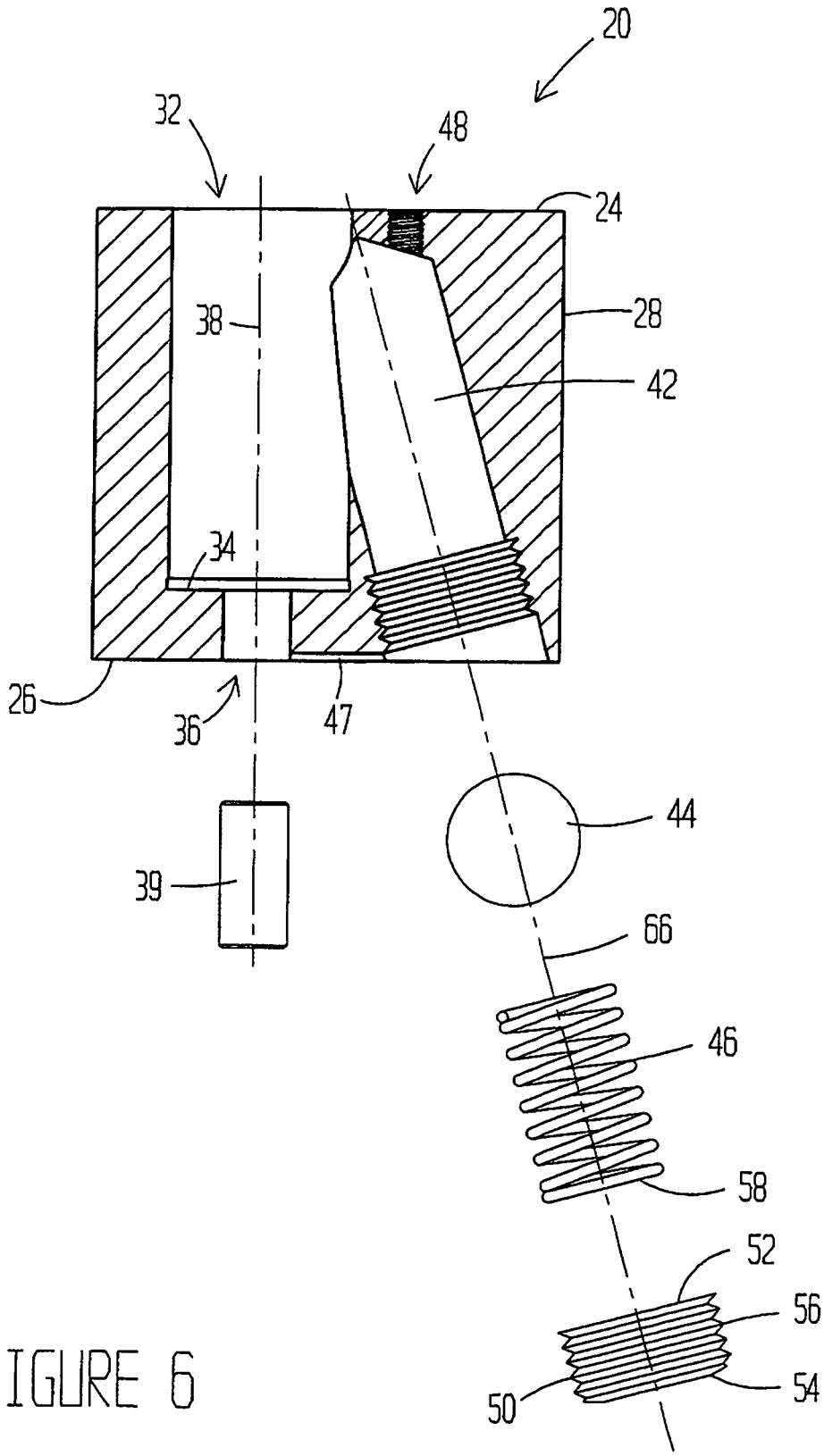
FIG. 6 is an exploded view of the retainer of FIG. 1 with the retainer shown in cross section similar to that of FIG. 5.
Figure 8:
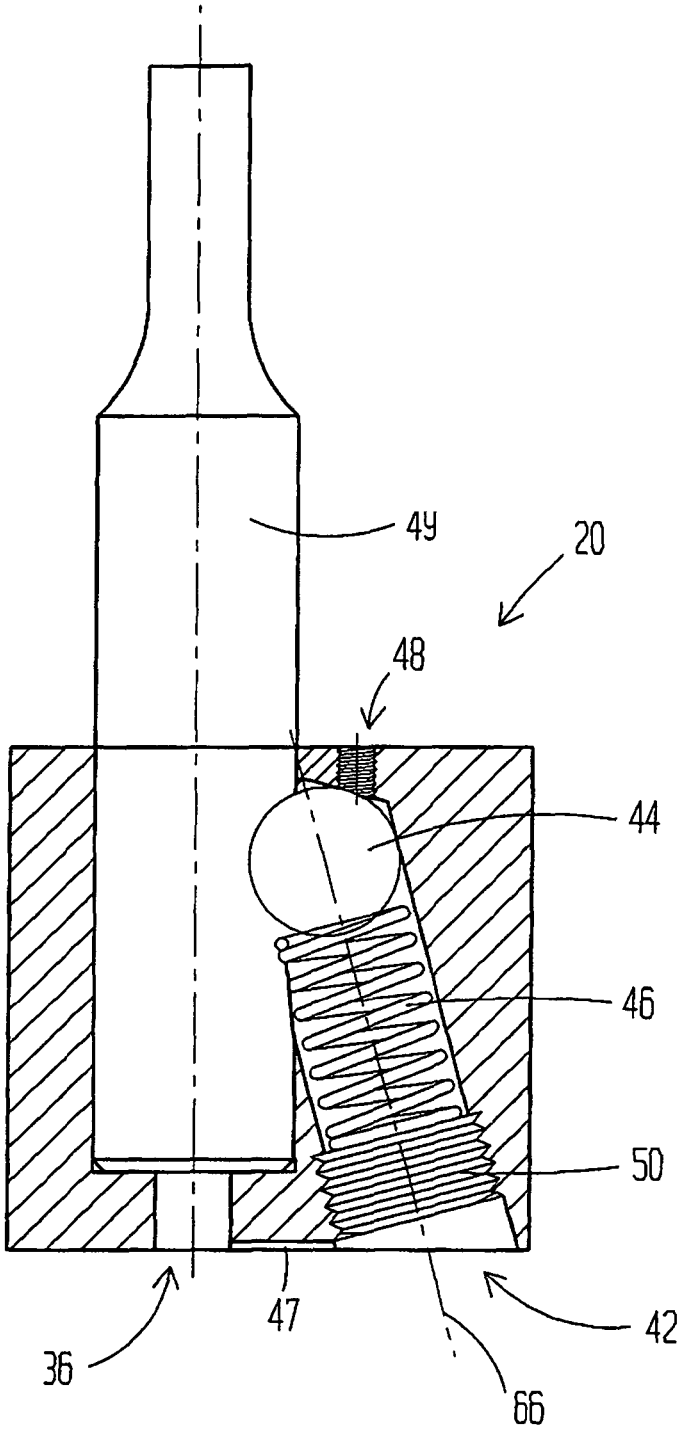
FIG. 8 is a cross-sectional view of the retainer showing a punch being retained therein.

An oblique hole or passage 42 intersects punch hole 32. A ball 44 is urged by a spring 46 to partially enter the bore of punch hole 32, as best shown in FIGS. 5 and 8. A small bore 48 extends into communication with oblique hole 42 for the insertion of an instrument to move ball 44 against spring 46 to release a punch 49, such as that shown in FIG. 8, located in punch hole 32. Bore 48 can be tapped, as shown, to allow the use of a threaded member, such as a set screw, to move ball 44 against spring 46 to release punch 49. The use of a threaded member can allow ball 44 to be held in a desired position thereby allowing the user the use of both hands to remove and insert a punch from retainer 20.

A vent passage 47 can extend between dowel pin hole 36 and oblique hole 42 along bottom surface 26. Vent hole 47 enables air entrapped in punch hole 32 due to the insertion of punch 49 therein to escape through oblique hole 42. Vent passage 47 is easily constructed on bottom surface 26 during the manufacture of retainer 20. Vent passage 47 can be a recessed channel that extends between dowel pin hole 36 and oblique hole 42. Vent passage 47 can extend to another passage or to side wall 28.

By the use of through hardened steel body 22, flat bottom 34 of punch hole 32 can accept the severe impact of forces of punch 49 positioned against flat bottom 34 and a separate hardened steel backing plate or plug is not required. Nevertheless, tool steel body 22 can be formed by machining out the various holes and forming threads therein before through hardening and then final grinding punch hole 32 and dowel pin hole 36. The need for a separate backing plate is eliminated but the press platen or die set is properly protected.

Figure 7:
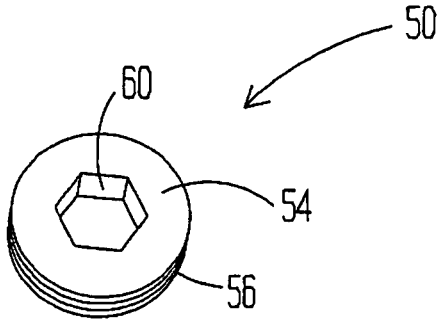
FIG. 7 is a perspective view of the retaining member utilized in the retainer.

To retain ball 44 and spring 46 within oblique hole 42, a retaining member 50, such as a set screw can be utilized. Set screw 50 includes opposite first and second surfaces 52, 54 with a threaded side wall 56 extending therebetween. First surface 52 is flat and engages with one end 58 of spring 46. Second surface 54 of set screw 50 can include an engagement feature 60, such as a hex-shaped recess as shown in FIG. 7, that enables set screw 50 to be rotated with an appropriate tool. A portion of oblique hole 42 includes threads 62 that are complementary to threaded side wall 56 of set screw 50. Set screw 50 engages with threads 62 in oblique hole 42 to retain spring 46 and ball 44 within oblique hole 42. An adhesive patch (not shown) can be included on threaded side wall 56 of set screw 50 to inhibit set screw 50 from disengaging with threads 62 of oblique hole 42 during production and use.

Spring 46 and set screw 50 are axially aligned with a centerline 66 of oblique hole 42. The axial alignment of spring 46 and set screw 50 facilitates a complete and thorough engagement between end 58 of spring 46 and first surface 52 of set screw 50. The axial alignment advantageously allows end 58 of spring 46 to engage with first surface 52 of set screw 50 without spring 46 being bent, twisted or distorted. That is, spring 46 is merely axially compressed within oblique hole 42 by the engagement with ball 44 and set screw 50. Additionally, the axial alignment of set screw 50 with oblique hole 42 facilitates the manufacture of retainer 20. The axial alignment provides economies by allowing oblique hole 42 to simply be tapped in its already-established position. That is, oblique hole 42 can be formed and then tapped. Thus, the axial alignment facilitates the construction of oblique hole 42 with threads 62 to retain the set screw 50 therein.

Retainer 20 according to the present teachings advantageously allows the use of a regular or readily-available spring 46 to bias ball 44 toward punch hole 32. That is, spring 46 does not require special features such as an enlarged end. Moreover, the use of a set screw 50 eliminates the need for an undercut to be formed in oblique hole 42. Additionally, the use of a set screw 50 eliminates the need for the use of a snap ring which can be difficult to install and uninstall. Moreover, the use of a set screw 50 advantageously allows the compression of spring 46 to be adjusted. That is, set screw 50 can initially be positioned within oblique hole 42 to cause a desired compression of spring 46 and a desired biasing force to be imparted on ball 44 by spring 46. As spring 46 fatigues or wears over time, set screw 50 can be adjusted to cause additional compression of spring 46 to compensate for the deterioration of spring 46. Alternatively, set screw 50 can be adjusted if additional force is desired to be imparted on ball 44 by spring 46. Thus, the use of set screw 50 advantageously allows an adjustment of the spring force imparted on ball 44 and can compensate for the fatigue of spring 46 during the life of retainer 20. Thus, the useful life of retainer 20 can be increased through the use of set screw 50.

Additionally, the retainer 20 according to the present teachings advantageously can utilize a single dowel pin hole 36 that engages with a single dowel pin to locate a punch disposed within retainer 20 in a desired orientation. The use of a single dowel hole 36 facilitates the manufacture of retainer 20. That is, the use of a single dowel hole 36 eliminates the need for additional dowel holes and the machining and manufacturing steps associated with producing these additional holes. Thus, retainer 20 according to the present teachings may be more economically produced than those including additional dowel pin holes. Moreover, the circular exterior side wall 28 of retainer 20 facilitates the manufacture of retainer 20 out of round bar stock and can eliminate the cost of shaping the raw material. The weight of the product is also reduced and money can be saved on raw material costs. The costs to heat treat retainer 20 can also be reduced. Moreover, the use of a single cap screw to retain retainer 20 to the platen or die set can also save the manufacturing costs associated with preparing additional holes for additional cap screws.

While retainer 20 according to the present teachings has been shown and disclosed with reference to retaining a punch therein, it should be appreciated that the teachings of this disclosure can also be used for retaining other members, such as a punch die. Moreover, while the retainer 20 of the present teachings is shown as not utilizing a backing plate or plug behind punch hole 32, it should be appreciated that a backing plate or plug could be utilized, if desired. While various materials have been disclosed, other materials can be readily used. Thus, the preceding description and examples of the present teachings are merely exemplary in nature and variations that do not depart from the gist of the present teachings can be employed without deviating from the spirit and scope of the present teachings. It is intended by the following claims to cover these and other departures from the disclosed teachings which fall in the true spirit of these teachings.

What is claimed is:

1. A punch retainer comprising:

a continuous cylindrical body having opposite first and second ends with a continuous cylindrical exterior sidewall extending therebetween, at least one of said ends being a flat surface;

a punch-retaining passage in said body;

a spring passage in said body, said spring passage having an intersecting area with said punch-retaining passage;

a ball disposed in said spring passage;

a spring disposed in said spring passage and biasing said ball toward said intersecting area;

only a single dowel passage for holding a locating dowel, said dowel passage located in said body and having opposite first and second ends with said first end being substantially flush with said flat surface and open to receive an aligning dowel pin through said first end, said dowel passage having a circular cross section with a substantially constant inner diameter between said first and second ends; and a retention feature operable to receive a fastener that secures said body to a press platen or die set, said retention feature consisting of a single fastener passage in said body.

2. The punch retainer of claim 1, wherein said spring passage has a threaded section and further comprising a threaded member disposed in said spring passage and engaged with said threaded section, said threaded member compressing said spring into said ball and retaining said spring in said spring passage, and said spring and said threaded member are coaxial with said spring passage.

3. The punch retainer of claim 1, wherein said body is a single solid piece of through hardened tool steel.

4. The punch retainer of claim 1, wherein said single fastener passage has a first portion with a first diameter and a second portion with a second diameter less than said first diameter.

5. The punch retainer of claim 1, further comprising a vent passage extending from said single dowel passage along said flat surface in a plane axially spaced apart from a plane in which an end of a punch resides when retained in said punch-retaining passage.

6. A punch retainer comprising:

a body having a flat surface for engaging a press platen;

a punch-retaining passage in said body;

a spring passage in said body, said spring passage having an intersecting area with said punch-retaining passage;

a ball disposed in said spring passage;

a spring disposed in said spring passage and biasing said ball toward said intersecting area;

a retention feature operable to receive a fastener that secures said body to a press platen or die set, said retention feature consisting of a single fastener passage in said body;

a single dowel passage for holding a locating dowel, said single dowel passage being coaxial to, and of a smaller diameter than, said punch-retaining passage; and a vent passage extending from said dowel passage along said flat surface in a plane axially spaced apart from a plane in which an end of a punch resides when retained in said punch-retaining passage.

7. The retainer of claim 6, wherein said vent passage extends along said flat surface between said dowel passage and said spring passage.

8. The retainer of claim 6, wherein said vent passage is open along said flat surface.

9. A punch retainer comprising:

a cylindrical body having opposite first and second ends with a continuous exterior side wall extending therebetween, at least one of said first and second ends being a flat surface, and said continuous side wall forming a cross-section having a circular exterior periphery at any axial location along said body between said first and second ends;

a punch-retaining passage in said body;

a spring passage in said body, said spring passage having an intersecting area with said punch-retaining passage;

a ball disposed in said spring passage;

a spring disposed in said spring passage and biasing said ball toward said intersecting area;

a retention feature operable to receive a fastener that secures said body to a press platen or die set, said retention feature consisting of a single fastener passage in said body; and a single dowel passage for holding a locating dowel.

10. The punch retainer of claim 9, wherein said dowel passage is coaxial to, and of a smaller diameter than, said punch-retaining passage.

11. The punch retainer of claim 9, further comprising a vent passage extending from said single dowel passage along said flat surface in a plane axially spaced apart from a plane in which an end of a punch resides when retained in said punch-retaining passage.

12. A punch retainer consisting of:

a cylindrical body having a flat surface;

a punch-retaining passage in said body;

a spring passage in said body, said spring passage having an intersecting area with said punch-retaining passage;

a ball disposed in said spring passage;

a spring disposed in said spring passage biasing said ball toward said intersecting area;

a single dowel passage for holding a locating dowel;

a single fastener passage in said body configured to receive a fastener to retain said body to a press platen or die set, said single fastener passage having a first portion with a first diameter and a second portion with a second diameter less than the first diameter;

a bore extending from an exterior of said body to the spring passage; and a vent passage communicating with at least one of said punch-retaining passage and said dowel passage.

13. The punch retainer of claim 12, wherein said single dowel passage is coaxial to, and of a smaller diameter than, said punch-retaining passage.

14. The punch retainer of claim 12, wherein said body is a single solid piece of through hardened tool steel.

15. The punch retainer of claim 12, wherein said vent passage extends along said flat surface between said dowel passage and said spring passage.

16. The punch retainer of claim 12, wherein said vent passage is open along said flat surface.

* * * * *